United States Patent [19]

Brown

[11] 4,370,961

[45] Feb. 1, 1983

[54] FUEL RATE CONTROL FOR INTERNAL COMBUSTION ENGINES

[76] Inventor: Derek Brown, 7 Southlands, Eighton Banks, Gateshead 9, Tyne & Wear NE9 7BP, England

[21] Appl. No.: 186,963

[22] Filed: Sep. 15, 1980

[51] Int. Cl.[3] ..... F02D 31/00

[52] U.S. Cl. ..... 123/352; 123/357; 123/360; 180/176

[58] Field of Search ..... 123/352, 357, 360; 180/176, 179

[56] References Cited

U.S. PATENT DOCUMENTS

| | | | |
|---|---|---|---|
| 3,237,108 | 2/1966 | Nakano | 328/1 |
| 3,425,401 | 2/1969 | Lang | 123/357 |
| 3,659,571 | 5/1972 | Lang | 123/357 |
| 3,698,829 | 10/1972 | Kubo et al. | 415/36 |
| 3,757,750 | 9/1973 | Ohtani | 123/352 |
| 3,946,707 | 3/1976 | Gray | 180/176 |
| 4,027,554 | 6/1977 | Ito et al. | 74/866 |
| 4,047,507 | 9/1977 | Noguchi et al. | 123/352 |
| 4,275,691 | 6/1981 | Wolff et al. | 123/352 |

FOREIGN PATENT DOCUMENTS

| | | |
|---|---|---|
| 2131249 | 12/1972 | Fed. Rep. of Germany . |
| 2020579 | 7/1970 | France . |
| 485574 | 5/1938 | United Kingdom . |
| 527325 | 11/1940 | United Kingdom . |
| 561536 | 5/1944 | United Kingdom . |
| 650695 | 2/1951 | United Kingdom . |
| 706743 | 4/1954 | United Kingdom . |
| 821116 | 9/1959 | United Kingdom . |
| 1080809 | 8/1967 | United Kingdom . |
| 1227726 | 4/1971 | United Kingdom . |
| 1280324 | 7/1972 | United Kingdom . |
| 1309711 | 3/1973 | United Kingdom . |
| 1332610 | 10/1973 | United Kingdom . |
| 1340879 | 12/1973 | United Kingdom . |
| 1437083 | 5/1976 | United Kingdom . |
| 1486530 | 9/1977 | United Kingdom . |
| 1490556 | 11/1977 | United Kingdom . |

*Primary Examiner*—Charles J. Myhre
*Assistant Examiner*—Andrew M. Dolinar
*Attorney, Agent, or Firm*—Holman & Stern

[57] ABSTRACT

A motor vehicle with power take-off apparatus is equipped with an arrangement for automatically controlling the rate of supply of fuel to an internal combustion engine which drives the power take-off output shaft. This arrangement has a sensor which produces pulses at a repetition speed proportional to the speed of rotation of the power take-off output shaft, and circuitry which provides an output signal at one binary level if the sensed speed of rotation rises higher than a first reference speed on increasing from zero, and at the other binary level if the sensed speed of rotation falls below a second, lower reference speed on decreasing from above the first reference rate. This binary signal is used to control the state, energized or de-energized, of a solenoid which in turn controls, directly or indirectly, a mechanical device which acts on the flow of fuel to the engine. The road speed of the vehicle can be limited automatically in the same way.

7 Claims, 14 Drawing Figures

FUEL RATE CONTROL FOR INTERNAL COMBUSTION ENGINES

BACKGROUND OF THE INVENTION

1. Field of the Invention

This invention relates to a vehicle equipped with at least one internal combustion engine having a means to control the rate of flow of fuel to the engine in operation.

A vehicle having road wheels driven by an internal combustion engine the operation of which is entirely controlled by the driver of the vehicle can be driven in such a manner as to use excessive amounts of fuel, to exceed legal speed limits, and incur excessive wear to the engine, the braking system, tires and other parts of the vehicle. It is therefore an object of the present invention to provide means capable of automatically preventing a driver from causing a motor vehicle to exceed a predetermined speed.

Motor vehicles are known which have an internal combustion engine of the injection type which uses diesel oil or gasoline and consequently has a fuel pump for controlling the rate of flow of fuel to the engine, the vehicle being equipped with power take-off apparatus which can be driven by this engine. There is, however, a difficulty involved in the use of the power take-off apparatus of such a vehicle in that the control over the rate of flow of fuel given by the usual manual or foot control arrangement for the fuel pump is very coarse in the middle range of the speed of rotation of the engine output shaft. FIG. 1 of the accompanying drawings shows an example of engine speed in r.p.m. against fuel input for an injection engine. It will be seen that control is good at low and high r.p.m. but very difficult in the range between 1,000 r.p.m. and 2,000 r.p.m.

2. Brief Summary of the Invention

It is an object of the present invention to provide means to overcome this difficulty in a way which does not involve the use of very complex and expensive fuel pumps which, while being satisfactory for power take-off requirements, are detrimental to the road performance of the vehicle where the engine is the engine which drives the powered road wheels of the vehicle. However, the invention is not limited to use in connection with vehicles employing injection engines for driving power take-off apparatus but applies whether the engine is either of the injection type of has other means controlling the flow of fuel to the engine, and applies whether or not the engine which is used to drive the power take-off apparatus is the same engine which drives road wheels of the vehicle.

In accordance with the invention, means are provided for sensing rotation of an output shaft driven by said engine and producing in response thereto a repetitive signal in which the duration of the repeated element is inversely related to the speed of rotation of the said output shaft. Electrical control means coupled to the sensing means receive the repetitive signal and are coupled to the means for controlling the rate of supply of fuel. These electrical control means are such that in use whenever the duration of the said repeated element becomes less than a predetermined duration when the speed of rotation of the said output shaft is increasing from zero, the electrical control means operate so that the means for controlling the rate of supply of fuel responds by reducing the rate of supply of fuel. The electrical control means are also such that the means for controlling the rate of supply of fuel does not allow the rate of supply of fuel to increase or be increased after the duration of the said repeated element becomes less than the said predetermined duration until the duration of the repeated element increases through a larger predetermined duration. Furthermore, the electrical control means may be such that whenever the of rotation of the said output shaft exceeds one or more further higher predetermined values after exceeding a first predetermined value corresponding to the first said duration the means for controlling the rate of supply of fuel responds thereto by further reducing the rate of supply of fuel.

The means for controlling the rate of supply of fuel may include a hand or foot operated member operable to control the rate of supply of fuel whenever the speed of rotation of the said output shaft is below the first said predetermined value.

Preferably, the means for sensing rotation of the said output shaft and producing in response thereto a repetitive signal is such that the repetitive signal consists of a stream of pulses.

Where the repetitive signal is a stream of pulses, the electrical control means may be such as to produce a binary signal which changes from one level to the other level in response to the speed of rotation of the said output shaft exceeding the said predetermined value. The binary signal can be used to effect energisation or de-energisation of electrical means so coupling the electrical control means to the means for controlling the rate of supply of fuel that a reduction in the rate of supply of fuel is effected by the means for controlling the rate of supply of fuel whenever the said electrical means is energised, or alternatively whenever the said electrical means is de-energised. The said electrical means may comprise a relay having a set of contacts which control the supplying of electrical power to a solenoid comprising a part of the means for controlling the rate of supply to fuel.

In a preferred embodiment in which the sensing means produces a streams of pulses, the electrical control means includes an astable multivibrator so coupled to the sensing means as to be inhibited for a predetermined interval at each pulse produced by the sensing means. Such coupling may include a switching device arranged to short-circuit a timing capacitor of the astable multivibrator in response to each pulse from the sensing means. Consequently if the pulse repetition rate exceeds the value at which the astable multivibrator is just able to begin a cycle of its astable operation, the astable multivibrator is inhibited, i.e. locked in one state. The astable multivibrator is so coupled to a monostable circuit in the preferred embodiment that the monostable circuit is triggered to or maintained in its set state by each occurrence of that part of the cycle of operation of the astable multivibrator which occurs only when the astable multivibrator is not inhibited. Consequently the monostable circuit is set and remains set when the astable multivibrator is not permanently inhibited, i.e. when the pulse repetition rate of the sensing means is low enough to allow at least part of a cycle of astable operation of the astable multivibrator to occur between the leading edges of each pair of successive pulses produced by the sensing means. When the pulse repetition rate of the sensing means is too high for this to occur, the astable multivibrator locks in a state which results in the monostable circuit returning to and remaining in its reset state while the multivibrator is thus locked. An output signal from the monostable circuit representative of the state of that circuit is thus a binary signal which changes from one level to the other level in response to the speed of rotation of the said output shaft exceeding the said predetermined value when increasing from zero.

In this preferred embodiment, a further switching device is provided for determining for which one of two possible values of the said predetermined interval the astable multivibrator is inhibited before carrying out its astable operation. The further switching device may, for this purpose, be arranged to short circuit, when closed, part of the resistance in the timing circuitry of the astable multivibrator. The further switching device is so controlled by the binary output signal of the monostable circuit that the astable multivibrator can carry out its astable operation after the shorter of the two inhibit intervals whenever the monostable circuit is in its set state, and vice versa. Consequently the rate of rotation of the said output shaft for which the monostable circuit is set again after being reset is a lower rate than the rate for which the monostable circuit is reset. This difference between the rates provides hysteresis in the controlling action of the electrical control means and prevents hunting.

Other advantageous features of the present invention will be better understood from the following description given by way of example with reference to the accompanying drawings.

DETAILED DESCRIPTION OF THE PREFERRED EMBODIMENTS

Figure 6:
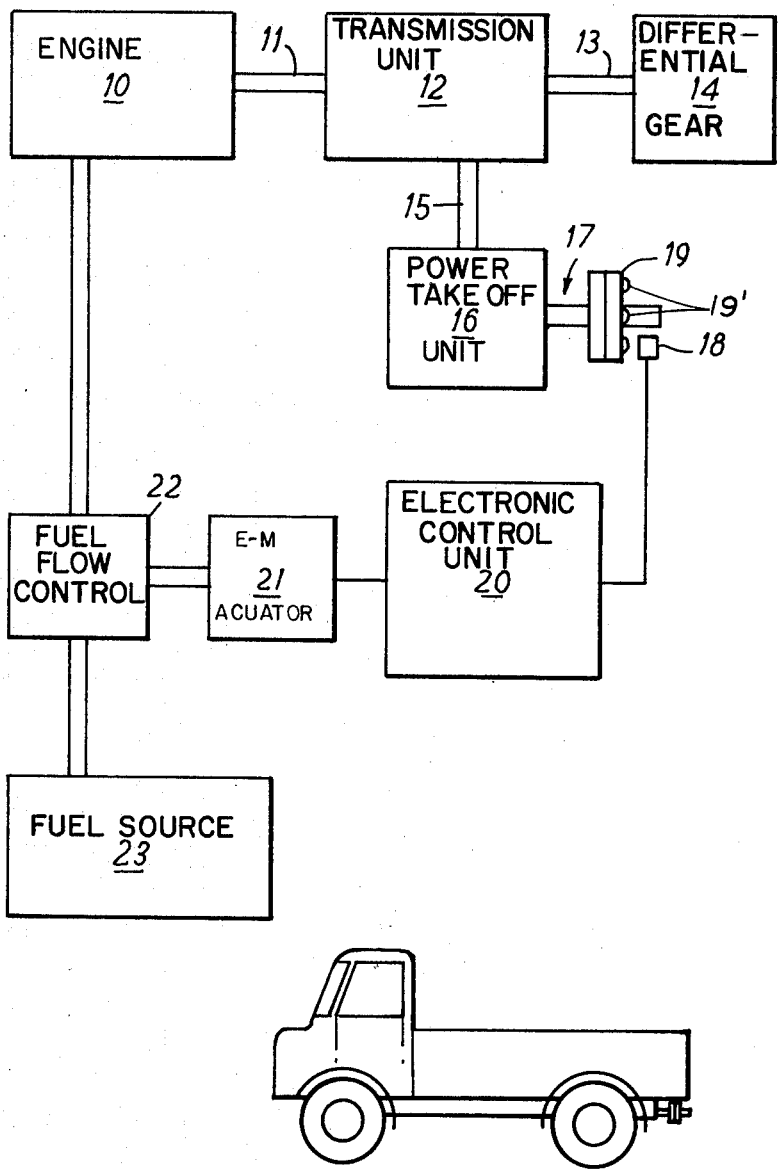
FIG. 6 is a block diagram of a power take-off system of a vehicle embodying the invention.

FIG. 6 shows in diagrammatic form a vehicle drive system including an internal combustion engine 10.

The engine 10 has a output shaft 11 coupled to a transmission unit 12. The transmission unit 12 has an output shaft 13 coupled to a differential gear 14 having a pair of output shafts (not shown) coupled respectively to two road wheels (not shown) and an output shaft 15 coupled to a power take-off unit 16 having a power take-off output shaft 17.

An inductive metal-proximity sensor 18 is mounted close to a bolted flange 19 of the power take-off output shaft 17 in a position in which the sensor 18 produces a stream of electric pulses whenever the flange 19 rotates in either direction, the sensor 18 being arranged to respond to the equingularly spaced bolt heads 19' on the flange 19. The repetition rate of the pulses is consequently directly proportional to the speed of rotation of the flange 19. The pulses generated by the sensor 18 in response to rotation of the flange 19 are supplied to an electronic control unit 20.

The control unit 20 controls a control solenoid of an electromechanical actuator arrangement 21 which acts upon a fuel flow control 22 controlling the flow of fuel to the engine 10 from a fuel source 23.

Figure 2:
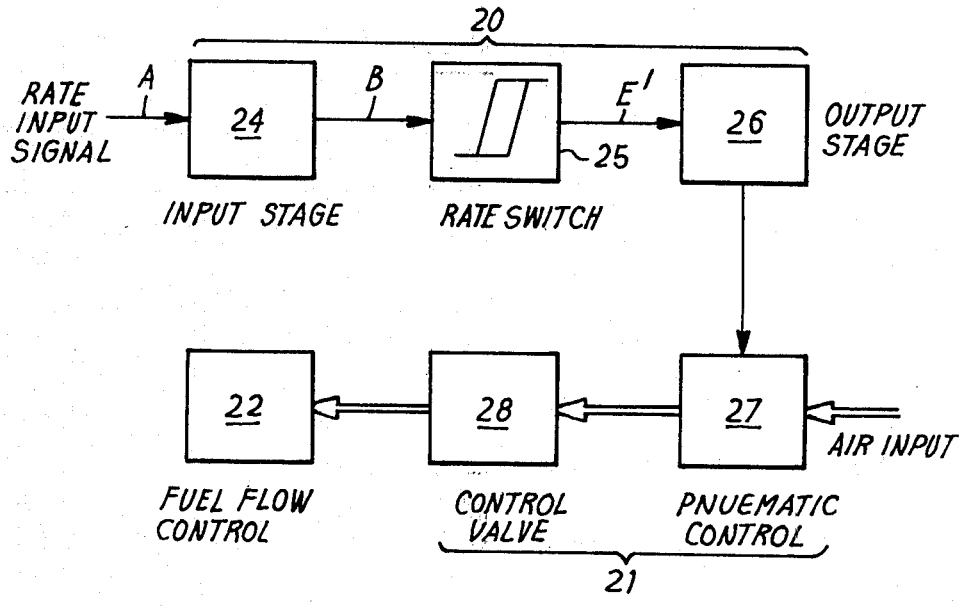
FIG. 2 is a block diagram of part of a power take-off system in an embodiment of the invention.

The control unit 20 and the electro-mechanical actuator arrangement 21 are represented in FIG. 2 which shows the control unit 20 consisting of an input stage 24, a rate switch 25 and an output stage 26, and the actuator arrangement 21 consisting of a pneumatic control 27 and a control valve 28. In operation, pulses produced at a terminal A by the sensor 18 are shaped by the input stage 24 to provide square pulses at a terminal B. The rate switch 25 responds to the pulses at B by providing a binary "on" or "off" signal at a terminal E'. The output stage 26 responds to an "on" signal at the terminal E' by energising a control solenoid in the pneumatic control 27 in the actuator arrangement 21. Energisation of this solenoid causes air to be passed through the pneumatic control 27 and thence through the control valve 28 to the fuel flow control 22. The supply of air to the fuel flow control 22 causes the flow of fuel to the engine 10 to be reduced to a predetermined limit. The output stage 26 responds to an "off" signal at the terminal E' by holding the control solenoid of the actuator arrangement 21 in a de-energised state so that no air passes to the fuel flow control 22, and the flow of fuel to the engine 10 from the source 23 is not restricted to the predetermined limit.

Figure 3:
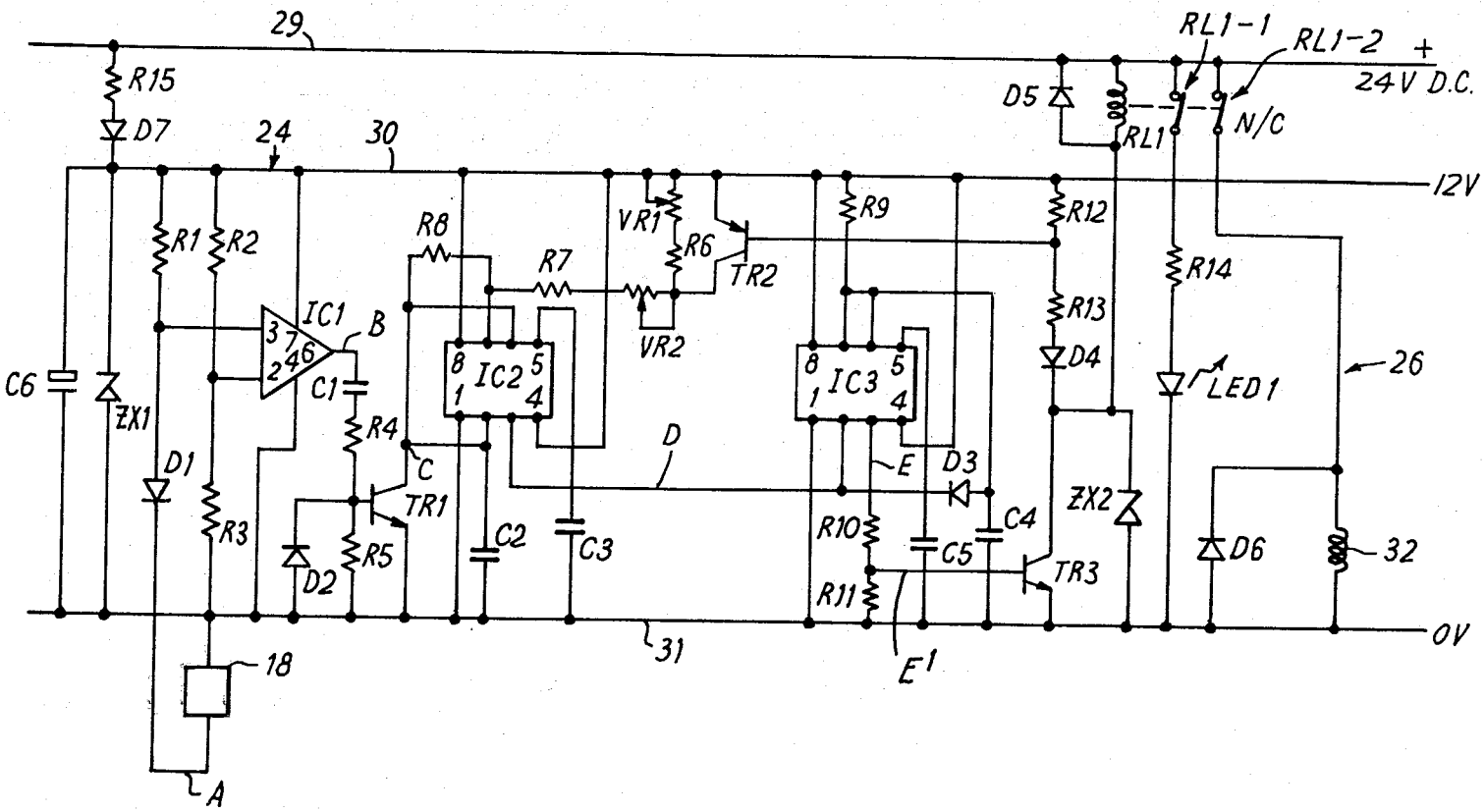
FIG. 3 is a circuit diagram of electrical equipment forming part of an embodiment of the invention.

FIG. 3 shows the circuitry of the control unit 20.

In FIG. 3, a positive voltage line 29 is coupled through a resistor R15 and a diode D7 to a positive rail 30 on which a positive voltage $V_{cc}$ of 12 volts is thus established. The diode D7 protects the circuitry from accidental reverse connection of the vehicle battery (not shown), and prevents a capacitor C6 connected between the positive rail 30 and a ground rail 31 from discharging during transients in the voltage on the line 29. The capacitor C6 and a Zener diode ZX1 in parallel therewith ensure that the voltage $V_{cc}$ is steady.

The sensor 18 has one output terminal connected to the ground rail 31 and another output terminal which is the terminal A connected to the input terminal of the input stage 24 which is a pulse shaping circuit connected between the rails 30 and 31 and having as its output terminal the terminal B. The sensor 18 together with the input stage 24 serve as means which sense rotation of the shaft 17 and produce in response thereto a repetitive signal in which the repeated element is inversely related to the speed of rotation of the shaft 17.

The shaping circuit includes an operational amplifier IC1 having its non-invert input terminal biased to a voltage $\frac{1}{2}$ $V_{cc}$ by connection to the connected ends of two equal resistors R2 and R3 connected in series between the rails 30 and 31. The invert input terminal of the amplifier IC1 receives positive voltage at the anode of a diode D1 having its cathode connected to the terminal A of the sensor 18 since a resistor R1 couples the invert terminal to the positive rail 30. The output terminal of the amplifier IC1 is the output terminal B.

The terminal B is coupled to the ground rail 31 by a differentiating circuit including a capacitor C1, a resistor R4 and the base-emitter junction of an NPN switching transistor TR1 with this junction connected in parallel with a resistor R5 to the ground rail 31 and its collector connected to a common point C in the timing circuitry of an astable multivibrator circuit which will now be described.

At this common point C, resistor R8 and a timing capacitor C2 are connected together, the capacitor C2 coupling the point C to the ground rail 31 and the point C being coupled to the positive rail 30 by three fixed timing resistors R6, R7 and R8 and two variable timing resistors VR1 and VR2 connected in series as shown. The variable resistor VR1 and the fixed resistor R6 can be short circuited by a PNP switching transistor TR2 the base of which is connected to receive controlling current from respective connected ends of two collector load resistors R12 and R13 connected in series between the positive rail 30 and the anode of a diode D4 which protects the base-emitter junction of the transistor TR2 against reverse polarity voltage. An integrated circuit IC2 having pins 1 to 8 has its pins 2 and 6 connected to the point C, its pin 7 connected to the connected ends of the resistors R7 and R8, its pin 1 connected to the ground rail 31, its pins 4 and 8 connected to the positive rail 30, its pin 5 coupled by a capacitor C3 to the ground rail 31, and its pin 3 connected to a terminal D. The integrated circuit IC2 is a Signetics NE/SE555 timer and acts as an astable multivibrator whose characteristic operating time is determined by the time constant established by the fixed resistors R6, R7 and R8, the capacitor C2, the variable resistors VR1 and VR2, and the transistor TR2. The integrated circuit IC2 operates such that the pin 3 is its output terminal.

Figure 4:
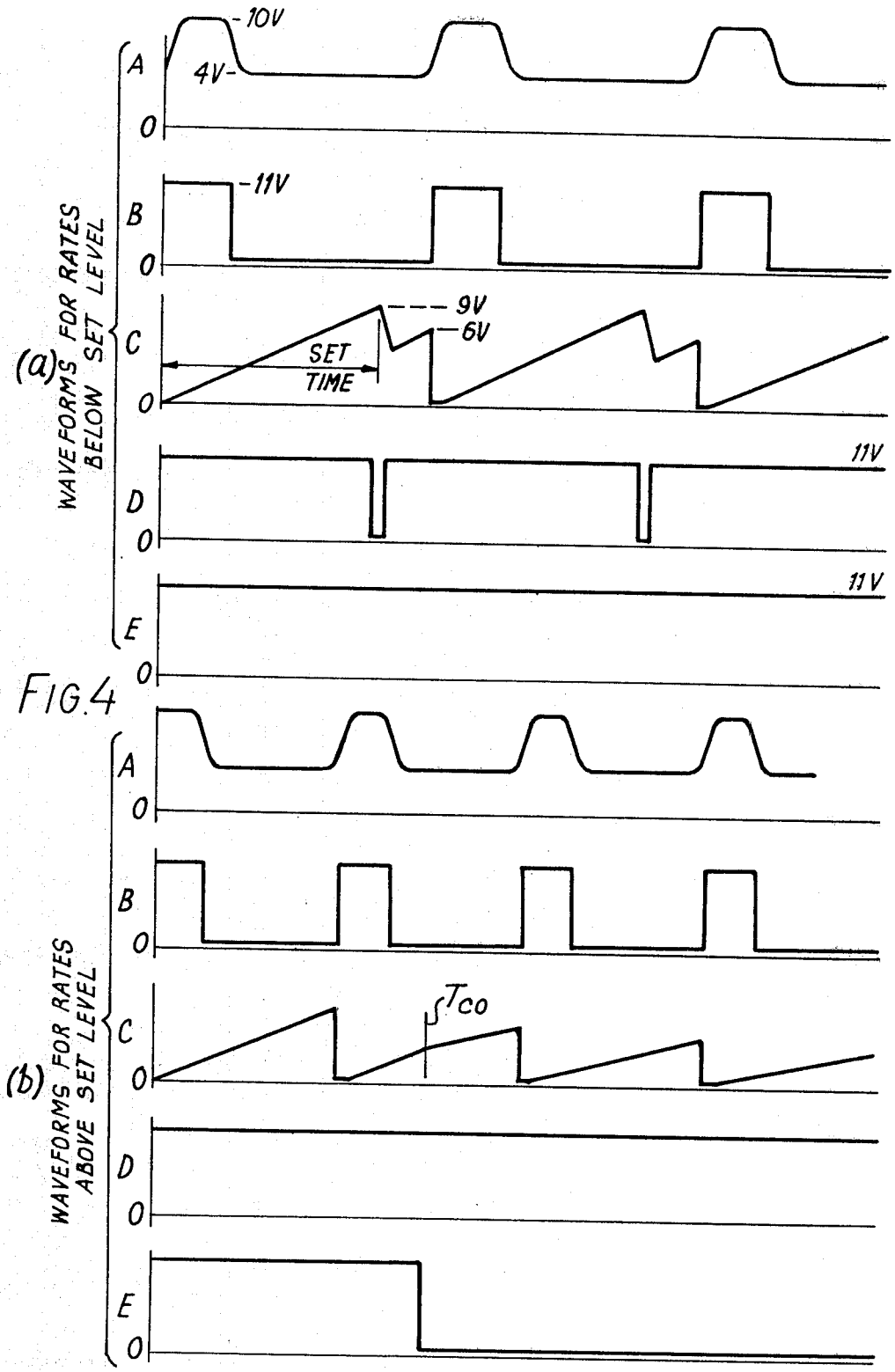
FIG. 4 is a set of graphical representations of waveforms found in use in the electrical equipment of FIG. 3.

FIG. 4 shows the voltage waveforms which appear at the terminals and points A, B, C and D, and a further point E in FIG. 3 under two different conditions.

In operation, the amplifier IC1 amplifies the pulses in the waveform at A to provide square pulses in the waveform at B. The circuitry coupling the point B to the point C acts as follows. Assuming that the capacitor C1 is in a discharged condition immediately before a positive pulse occurs at B, the pulse at B causes the voltage $V_{cc}$ to be applied across the resistors R4 and R5 with the result that the transistor TR1 is biased into its on state and the capacitor C2 is rapidly discharged through the transistor TR1 and remains with zero volts across it until the transistor TR1 turns off. The capacitor C1 charges rapidly through the resistor R4 and the base-emitter junction of the transistor TR1 so that the voltage at the base of the transistor TR1 quickly falls and the transistor TR1 turns off. The voltage at C then begins to rise as the capacitor C2 charges through the resistors R7, R8 and VR2 and the transistor TR2 or the resistors R6 and VR1.

A diode D2 protects the base-emitter junction of the transistor TR1 against damaging levels of reverse bias at the occurrence of the trailing edges of the pulses at B.

If the voltage at C has sufficient time to reach $\frac{2}{3}$ $V_{cc}$ the integrated circuit IC2 begins to operate as an astable multivibrator discharging the capacitor C2 internally from $\frac{2}{3}$ $V_{cc}$ to a voltage $\frac{1}{3}$ $V_{cc}$ within a shorter time. The voltage at pin 2 and hence at C would rise to the voltage $\frac{2}{3}$ $V_{cc}$ and fall again to $\frac{1}{3}$ $V_{cc}$ repeatedly except for the occurrence of a succeeding pulse at B which discharges the capacitor C2 to zero. During the astable phase of discharge of the capacitor C2 from $\frac{2}{3}$ $V_{cc}$ to $\frac{1}{3}$ $V_{cc}$ the voltage at pin 3 and hence at D is substantially at zero volts.

If the power take-off unit 16 is not operating, no pulses occur at B, and the integrated circuit IC2 with its timing circuitry operates as an astable multivibrator continuously.

In the output stage 26, an NPN switching transistor TR3 has its base connected to the point E' and is associated with a relay RL1 which has two sets of normally-closed contacts RL1-1 and RL1-2 each having a fixed contact connected to the 24 volt positive voltage line 29 and respective movable contacts. The movable contact of the set RL-1 is connected to a light emitting diode LED1 with a protective resistor R14 in series therewith, the cathode of the diode LED1 being connected to the ground rail 31. The movable contact of the set RL-2 is connected to the solenoid 32 of an electro-pneumatic valve, which in this example constitutes the pneumatic control 27, so that the solenoid is connected between the movable contact of the set RL1-2 and the ground rail 31. A protective diode D6 is connected in parallel with the solenoid of the valve, and a protective diode D5 is connected in parallel with the winding of the relay RL1 which has one end thereof connected to the 24 volt positive line 29 and the other end thereof connected to the collector of the transistor TR3, the emitter of which is connected to the ground rail 31. A zener diode ZX2 in parallel with the transistor TR3 is normally not conducting and serves to protect the transistor TR3 from excessive voltage which may occur on the positive line 29.

The relay RL1 is energised when the transistor TR3 is on, and is in its de-energised state when the transistor TR3 is off. The movable contacts of the sets RL1-1 and RL1-2 rest in contact with their fixed contacts whenever the relay RL1 is in its de-energised state, and are held away from their fixed contacts whenever the relay RL1 is in its energised state.

It will be seen that two time constants are associated with the capacitor C2, one serving when the transistor TR2 is off, and another serving when the transistor TR2 is on. These time constants are selected automatically in accordance with the state of the relay RL1, the transistor TR2 being on when the transistor TR3 is on, and the transistor TR2 being off when the transistor TR3 is off.

The output pin 3 of the integrated circuit IC2 is connected at the point D to the input pin 2 of a further integrated circuit IC3 which is also a Signetics Timer NE/SE555 but is connected between the rails 30 and 31 to operate as a monostable circuit, its pins 6 and 7 being connected together at a point which is coupled by a resistor R9 to the positive rail 30 and by a capacitor C4 to the ground rail 31, the resistor R9 and the capacitor C4 determining the time constant of this monostable circuit. Direct connections to the rails 30 and 31 are provided for the IC3 as for IC2 at the pins 1, 4 and 8, and the pin 5 is again coupled to the ground rail 31 by a capacitor C5. The pins 6 and 7 are also connected to the anode of a diode D3 which couples these pins to the point D so that the capacitor C4 can be discharged to the output pin 3 of IC2 when this pin 3 is at substantially zero volts.

The output pin 3 of the integrated circuit IC3 is connected at a point E to two resistors R10 and R11 in series which couple the point E to the ground rail 31. The connected ends of the resistors R10 and R11 are connected at the point E' to the base of the transistor TR3 so that an attenuated version of the waveform appearing in operation at E controls the transistor TR3.

When the power take-off output shaft 17 is rotating at less than a reference rate determined by the state of the transistor TR2, the time between successive leading edges of the pulses at B is sufficiently long for the voltage at C to reach $\frac{2}{3}$ $V_{cc}$ from zero volts. Consequently the integrated circuit IC2 operates for a short time as an astable multivibrator so that the voltage at C tends to oscillate between $\frac{2}{3}$ $V_{cc}$ and $\frac{1}{3}$ $V_{cc}$ and the voltage at D is switched to zero for a short time starting at the time at which the voltage at C reaches $\frac{2}{3}$ $V_{cc}$. The time taken for the voltage at C to reach $\frac{2}{3}$ $V_{cc}$ from zero, i.e. the SET TIME illustrated in FIG. 4, has either one of two values depending upon whether the transistor TR2 is on or off. When the relay RL1 is in its energised state the solenoid 32 is not energised, the transistor TR2 is on, and the resultant SET TIME is that for a reference rate of x r.p.m. The SET TIME can be regarded as an inhibit interval for the astable multivibrator.

The time constant of the monostable circuit of IC3 is determined by the time taken by the capacitor C4 to charge from zero to $\frac{2}{3}$ $V_{cc}$ volts, the monostable circuit being reset by the voltage at the pins 6 and 7 of IC3 reaching $\frac{2}{3}$ $V_{cc}$ volts. The capacitor C4 is, however, discharged to zero through the diode D3 each time the voltage at D is at substantially zero, i.e. whenever the output voltage in the astable operation of IC2 reaches substantially zero. It is arranged that the time for the capacitor C4 to charge from zero to $\frac{2}{3}$ $V_{cc}$ is greater than the time between leading edges of successive pulses at B when the power take-off output shaft 17 is rotating at the minimum value of x r.p.m. that the variable resistors VR1 and VR2 will allow, i.e. greater than the longest SET TIME. However slowly the output shaft 17 rotates under the reference rate, the voltage at D switches between $V_{cc}$ and zero sufficiently frequently to prevent the voltage at pins 6 and 7 of IC3 reaching $\frac{2}{3}$ $V_{cc}$. Consequently, the voltage at E remains high at almost $V_{cc}$ as illustrated at (a) in FIG. 4, i.e. the monostable circuit with IC3 is held in its set state while the output shaft 17 is rotating at less than the reference rate.

If the rate of rotation of the power take-off output shaft 17 is now increased until it exceeds x r.p.m., the events illustrated at (b) in FIG. 4 take place. The time between the leading edges of successive pulses at B is less than before to the extent that the voltage at C no longer reaches $\frac{2}{3}$ $V_{cc}$ before dropping back to zero as a result of the switching on of the transistor TR1. Consequently, the voltate at D remains at almost $V_{cc}$ i.e. the astable multivibrator is inhibited, being locked in one state. As a result, the voltage at the pins 6 and 7 of IC3 ramps up to $\frac{2}{3}$ $V_{cc}$, whereupon the capacitor C4 is discharged to zero by an internal circuit of the integrated circuit IC3, i.e. the monostable circuit of IC3 resets. The capacitor C4 is held discharged until the voltage at D drops to zero again, which it does not do until the rate of rotation falls below a different reference rate of y r.p.m. Thus as the rate of rotation of the output shaft increases through x r.p.m. the voltage at E, with a slight delay, drops from $V_{cc}$ to zero, the transistor TR3 is switched off, the relay RL1 de-energises, and the solenoid 32 of the electro-pneumatic valve is energised.

When the rate of rotation is being decreased, but is above the reference rate of y r.p.m., the voltage at the pins 6 and 7 of IC3 and at E is zero, the voltage at D is $V_{cc}$, and the voltage at C is below $\frac{2}{3}$ $V_{cc}$. The charging time for the capacitor C2 is now determined by the resistors VR1, R6, VR2, R7 and R8, the transistor TR2 being off. The change from the shorter charging time when the transistor TR2 is on to this longer charging time with the transistor TR2 off can be seen in waveform C in part (b) of FIG. 4 at a time $T_{co}$ when the voltage at E switches from $V_{cc}$ to zero, thereby switching off the transistor TR3. It will be realised that the longer charging time for the capacitor C2 determines the value of y r.p.m., in the same way that the value of x r.p.m. is determined by the charging time for C2 when TR2 is on. When the rate of rotation has fallen to y r.p.m., the voltage at C can reach $\frac{2}{3}$ $V_{cc}$ and the voltage at D switches to zero, thereby unclamping the voltages at the pins 6 and 7 of IC3 and switching E to $V_{cc}$, so that the transistors TR3 and TR2 switch on, the relay R1 is energised, and the solenoid 32 of the electro-pneumatic valve is de-energised. The rate y r.p.m. is lower than the rate x r.p.m. This difference between the rates provides hysteresis in the controlling action of the electronic control unit 20 and prevents hunting, the binary signal which is the monostable output voltage at E switching from $V_{cc}$ to zero at x r.p.m. whenever the rate rises from below y r.p.m. to above x r.p.m., and switching from zero to $V_{cc}$ at y r.p.m. whenever the rate falls from above x r.p.m. to below y r.p.m.

Comparing FIGS. 2 and 3 it will be seen that the rate switch 25 is constituted by the combination of the circuitry coupling the point B to the point C, the astable multivibrator circuit of IC2, and the monostable circuit of IC3, and that the output signal of the rate switch 25 is an attenuated form of the binary signal produced by the monostable circuit of IC3 at the point E, the point E' being connected to the connected ends of the series resistors R10 and R11 which couple the point E to the ground rail 31.

In the output stage 26 of FIG. 3, the relay RL1 has its contact sets RL1-1 and RL1-2 closed when the rate switch output signal at E' is low, indicating that the power output shaft 17 is rotating at a rate higher than required. An alternative example can easily be constructed in which the relay contacts are open when the output shaft 17 is rotating at a rate greater than a reference rate by replacing the relay RL1 with one of the type which has its contacts open when the relay coil is not energised, and closed when the coil is energised. If the electro-mechanical actuator arrangement 21 and the fuel flow control 22 are in such a case arranged to increase the flow of fuel to the engine 10 when the solenoid 32 is energised, the system of FIG. 6 operates to ensure that the rate of rotation of the power take-off output shaft 17 does not fall below a predetermined rate. In this case, the solenoid 32 is energised whenever the relay RL1 is energised, and the solenoid 32 is de-energised whenever the relay RL1 is de-energised. Consequently, when electric power is first supplied to the thus modified circuit of FIG. 3, the flow of fuel to the engine 10 is increased by the operation of the solenoid 32 until the rate of rotation of the shaft 17 reaches x r.p.m. whereupon the solenoid 32 is de-energised and the flow of fuel may remain at the prevailing level or decrease under the action of, for example, a return spring (not shown), acting on the armature (not shown) of the solenoid or on some other element in the electromechanical arrangement acting on the fuel flow control 22. When the rate decreases, for whatever reason, from x r.p.m., and reaches y r.p.m., the solenoid 32 will again be energised and the flow of fuel will be increased so that rate of rotation of the shaft 17 tends to rise to x r.p.m. Thus the rate of rotation of power take-off output shaft 17 can be so controlled, fully automatically, as to increase from zero at starting to reach x r.p.m. and to remain between the two limits x r.p.m. and y r.p.m. for as long as the power take-off system is operating with the modified circuit of FIG. 3. To stop the rotation of the shaft 17, the electrical supply to the modified circuit of FIG. 3 is switched off and the aforementioned return spring (not shown) or an equivalent means decreases the flow of fuel to zero.

When the apparatus has a control unit 20 as first described with reference to FIG. 3, i.e. with the relay RL1 having normally closed contact sets RL1 and RL2, a degree of mechanical control, which may be exercised through a hand or foot operated control member, is retained in that the rate of rotation of the shaft 17 is mechanically controlled directly by the user at rates below x r.p.m. when the rate is being varied from below y r.p.m. Such mechanical control, or other control independent of rotation of the power take-off shaft is normally necessary where the engine which drives the power take-off shaft is also the engine which drives the driven road wheels of the vehicle, as in the example of FIG. 6.

Figure 5:
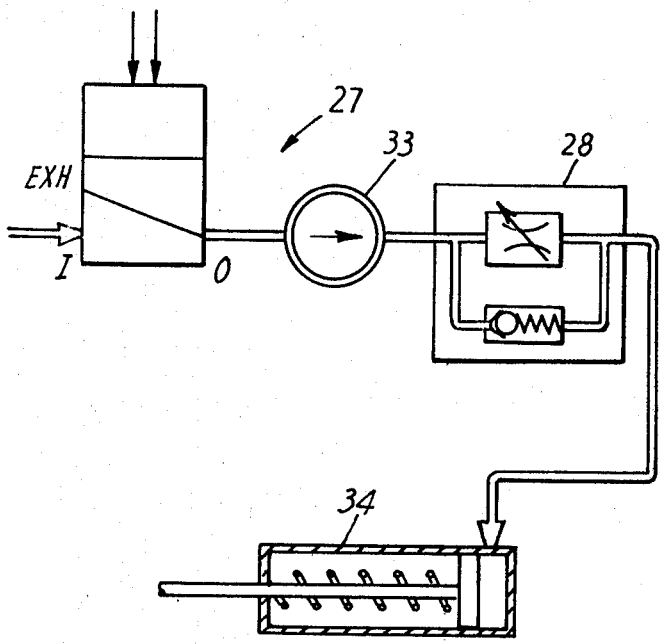
FIG. 5 is a schematic view of pneumatic circuitry forming part of an embodiment of the invention.

FIG. 5 shows one example of the pneumatic control 27 in the form of an electro-pneumatic valve, incorporating the solenoid 32 (not shown in FIG. 5) as its electrical actuating means, together with a pressure regulator 33 connected to receive air from the output port O of the valve and to the control valve 28 which consists of a spring-loaded non-return valve in parallel with an adjustable restrictor connected to a control element in the form of a pneumatic actuator 34 comprising a cylinder containing a piston and a return spring arranged to drive the piston towards one end of the cylinder when the air supplied to the cylinder through the control 27 and the valve 28 is slightly above atmospheric pressure.

The pneumatic control 27 of FIG. 5 is suitable for use with the circuit of FIG. 3 when the electro-pneumatic valve is actuated, i.e. its output port O is set in communication with its input port I, by energisation of the solenoid 32 whenever the rate of rotation of the output shaft 17 exceeds x r.p.m. Air supplied by the vehicle's compressed air source (not shown) to the input port I when the electro-pneumatic valve is actuated is then supplied through the regulator 33 and the non-return valve of the control valve 28 to the pneumatic actuator 34 so that its piston is rapidly pushed back against the return spring of the actuator 34. Subsequent de-energisation of the solenoid results in the output port O being shut off from the input port I and placed in communication with the exhaust port EXH of the electro-pneumatic valve. Consequently, the compressed air in the actuator 34 is driven out through the adjustable restrictor of the control valve 28, and thence through the regulator 33 and the electro-pneumatic valve to the atmosphere, the non-return valve of the control valve 28 being shut so that this escape of air from the actuator 34 is relatively gradual.

In the modified example where the solenoid 32 is energised at the start to bring the rate of rotation up to x r.p.m. and is subsequently de-energised until the rate falls below y r.p.m., the electro-mechanical actuator arrangement and control element of FIG. 5 is preferably also modified by reversing the direction of opening of the non-return valve so that instead of opening under the action of a flow of air from the regulator 33 to the actuator 34, it is arranged to open under the action of a flow of air from the actuator 34 to the regulator 33. In this modified form, the adjustable restrictor of the control valve 28 determines the rate at which the piston of the actuator 34 is driven back against the return spring of the actuator, the non-return valve being shut, and the expulsion of air from the actuator 34 when the output port O is in communication with the exhaust port EXH is effected rapidly through the non-return valve of the control valve 28.

Figure 7:
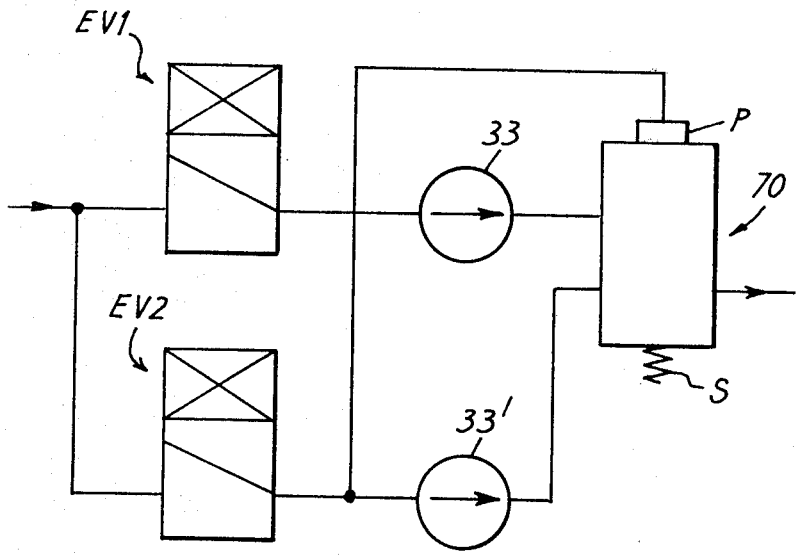
FIGS. 7 and 8 are schematic views of pneumatic circuitry for use in two different embodiments of the invention.
Figure 9:
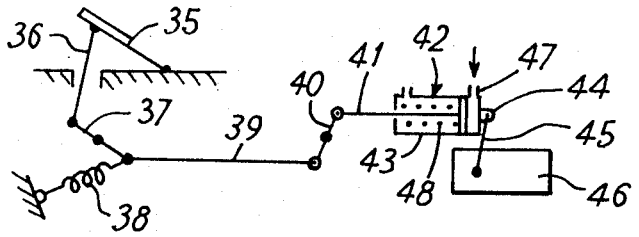
FIGS. 9, 10 and 11 are schematic views of fuel flow control equipment in three different embodiments of the invention.
Figure 10:
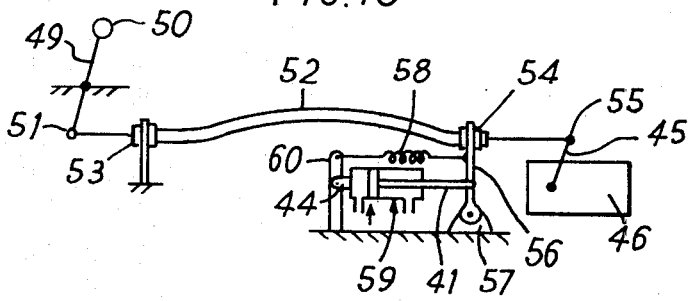

FIG. 9 shows schematically a control linkage for a vehicle accelerator control in which an accelerator pedal 35 is coupled by a rigid link 36 to a centrally pivoted lever 37 having its end remote from its pivotal connection to the link 36 attached to a return spring 38 and pivotally connected to a rigid transmission link 39 coupled by another centrally pivoted lever 40 to the outside end of the piston rod 41 of a pneumatic actuator 42 such as the actuator 34 of FIG. 5. The cylinder 43 of the actuator 42 has at its end remote from the outside end of the rod 41 a lug 44 pivotally connected to the end of a control lever 45 of a fuel pump 46 of an injection engine (not shown) which may be the engine 10 of FIG. 6. Actuating air from a control valve such as the valve 28 of FIG. 5 is supplied to the air inlet 47 of the actuator 42. The arrangement of FIG. 9 is such that when the return spring 48 of the actuator 42 is in its relaxed state as illustrated in FIG. 9, depression of the accelerator pedal 35 to the maximum extent results in the fuel pump lever 45 turning counter-clockwise to the position for maximum flow of fuel to the engine. When compressed air is allowed into the actuator 42, through port 47 the spring 48 is compressed and the distance between the outside end of the piston rod 41 and the lug 44 is increased to a predetermined extent. Consequently, maximum depression of the accelerator pedal 35 now results in the fuel spring lever 45 turning counter-clockwise to a predetermined limit position which is short, by a predetermined amount, of the position for maximum flow of fuel to the engine. Hence, if while the pedal 35 is being held down at its position of maximum depression the actuator is initially unpressurised, so that the spring 48 is in its relaxed state, air supplied to the actuator 42 through port 47 compresses the spring 48, and the fuel pump lever 45 will turn back clockwise from the position for maximum flow of fuel to the predetermined limit position. Thus, the engine can be slowed down while the accelerator pedal 35 is depressed. In such an example, the pedal 35 is used to control the engine during operation of the power take-off system which is as described hereinbefore with reference to FIGS. 2, 3, 4, 5 and 6, the linkage and fuel pump 46 of FIG. 9 constituting the fuel flow control 22 of FIG. 6.

Where a vehicle has a separate, manually operable lever for controlling a power take-off system, the fuel flow control 22 may be as shown in FIG. 10 where a centrally pivoted lever 49 has a hand knob 50 at an accessible end and is pivotally connected at the other end to one end 51 of a transmission cable having a sheath 52 with its end 53 adjacent the cable end 51 fixed and its end 54 adjacent the other cable end 55 mounted on the free end of a lever 56 with a fixed pivotal mounting 57. The other end 55 of the cable is pivotally connected to the free end of the control lever 45 of the fuel pump 46. The lever 56 is coupled to a fixed post 60 by a return tension spring 58 and a pneumatic actuator 59 which in this case does not require its own return spring. Pressurisation of the actuator 59 turns the lever 56 clockwise against the tension of the return spring 58 and increases the distance between the ends 53 and 54 of the sheath of the cable, thereby driving the end 55 of the cable further away from its end 51. Consequently, pressurisation of the actuator 59 while the knob 50 is held in any particular position causes the fuel pump lever 55 to be rotated clockwise which, it is arranged, results in a reduction of the flow of fuel, as in the arrangement of FIG. 9.

Where it is desirable to have a second upper limit z r.p.m. which is a higher rate of rotation than x r.p.m., a second circuit corresponding to FIG. 3 is provided with the timing chosen to replace x r.p.m. with z r.p.m. and y r.p.m. with (z-a) r.p.m. where, say $a=x-y$,, and the solenoid 32 of this second circuit according to FIG. 3 is the solenoid of a second electro-pneumatic valve. The two electro-pneumatic valves, EV1 and EV2, are used as shown in FIG. 7, each supplying its respective pressure regulator 33 or 33' and the outputs of the regulators being connected to the two input ports of a pilot operated spring returned air valve 70. The output port of the valve 70 is in communication with a control valve such as the valve 28 of FIG. 5. The pilot P of the valve 70 is connected to be supplied with air from the output port of the second electro-pneumatic valve EV2 and, when thus supplied, holds the output port of the valve 70 in communication with that one of its input ports which communicates with the regulator 33' of the second electro-pneumatic valve EV2. In the absence of a compressed air supply from the output port of the second valve EV2, the return spring S of the valve 70 holds the output port of the valve 70 in communication with the other input port, which is in communication with the regulator 33.

In operation, while the rate of rotation of the output shaft 17 increases from below y r.p.m. to below x r.p.m. both valves EV1 and EV2 vent their output ports to atmosphere, their solenoids being in the de-energised state. When the rate exceeds x r.p.m. the first value EV1 is actuated and air at a pressure determined by the regulator 33 is supplied to the valve 70. This pressure is lower than that determined by the regulator 33' when the regulator 33' is being supplied. While the rate is between x r.p.m. and z r.p.m., the valve EV2 is not actuated, and the air from the regulator 33 passes through the pilot operated valve 70. Above z r.p.m. both valves EV1 and EV2 are actuated but the pilot P of the valve 70 stops the flow of air from the regulator 33 and allows the flow of air, at higher pressure, from the regulator 33'. Consequently, with a suitable return spring for the pneumatic actuator supplied by the arrangement of FIG. 7, e.g. the actuator 34, or 42 or 59, the fuel pump lever can be turned back by a first, smaller amount at the occurrence of a rate between x r.p.m. and z r.p.m. and by a second, larger amount at the occurrence of a rate exceeding z r.p.m. Thus a two stage control can be effected. Control with more stages than two can be provided using further suitable circuits according to FIG. 3 and further overriding pneumatic branches having an electro-pneumatic valve, a pressure regulator and a pilot operated spring returned air valve.

Figure 11:
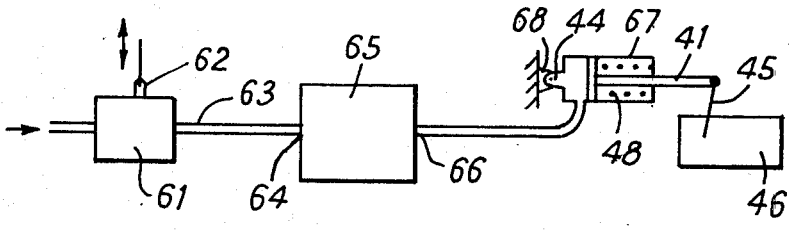

FIG. 11 represents another form of fuel flow control in which a first pneumatic control 61 with a control member 62 actuable by a user of the vehicle controls the pressure of compressed air supplied thereto. The output port 63 of the control 61 communicates with the input port 64 of an electro-pneumatic control unit 65 of which the output port 66 communicates with a pneumatic actuator 67 of the same kind as the actuator 34 of FIG. 5. The actuator 67 has a piston rod 41, a return spring 48 and a lug 44 as does the actuator 42 of FIG. 9. However, in the arrangement of FIG. 11, the lug 44 is pivoted on a fixed mounting 68 and the rod 41 is pivotally connected to the free end of the control lever 45 of the fuel pump 46. The electro-pneumatic control unit 65 has an electro-pneumatic valve 69 shown in FIG. 8 and a pressure regulator 71 connected thereto as shown. The output port of the electro-pneumatic valve 69 is the output port 66 of the unit 65.

Figure 8:
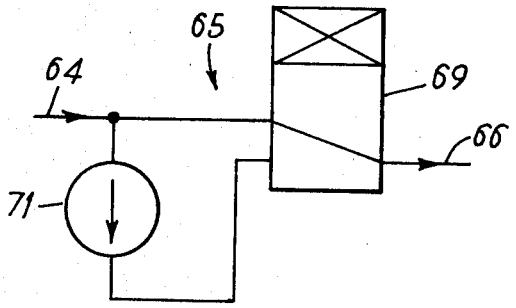

Energisation of the solenoid of the valve 69, which in this example is the solenoid 32 of a circuit according to FIG. 3, causes the pressure at the output port 66 to be reduced by the drop introduced by the regulator 71. FIG. 8 shows a one stage control unit 65. However, electro-pneumatic control units having a plurality of stages to produce control similar to that of FIG. 7 or corresponding arrangements with three or more electro-pneumatic valves can be constructed by simply connecting the required plurality of arrangements according to FIG. 8 in series with one another, these stages having respective pressure regulators which produce equal pressure drops if equal steps in the control are required.

The fuel flow control of FIG. 11 is used with the actuator 67 and fuel pump 46 so arranged that as the actuator 67 is pressurised, the fuel pump lever 45 turns clockwise to positions of increasingly higher rates of flow of fuel. Hence, with the electro-pneumatic control unit 65 of FIG. 8, actuation of the valve 69 causes a reduction in the speed of flow of fuel. To achieve a form of control in which the rate of rotation of the output shaft 17 is increased automatically from zero to x r.p.m. and then held at the lower rate of y r.p.m., the first control 61 may simply be dispensed with and the control unit 65 of FIG. 8 is used with the circuit of FIG. 3 as described so that the solenoid 32 is energised above x r.p.m. on increase of shaft speed from zero and remains thereafter energised above y r.p.m. However, a more satisfactory system for achieving such control is provided by again dispensing with the first control 61 and modifying the unit 65 of FIG. 8 by reconnecting the regulator 71 so that the input port 64 communicates with the output port 66 through the regulator 71 when the valve 69 is not actuated, and that the input port 64 communicates with the output port 66 directly through the valve 69 when the valve 69 is in its actuated state, the circuit of FIG. 3 being so modified that the solenoid 32 is energised while the output shaft speed increases from zero to x r.p.m. and is thereupon de-energised until the speed falls below y r.p.m.

In a simple example of a form of control in which the speed of rotation of the output shaft 17 of FIG. 6 is increased from zero to a predetermined rate and held substantially at that predetermined rate, the fuel flow control 22 of FIG. 6 consists of a fuel pump having its lever directly connected to and positioned by the piston rod of the actuator 34 of FIG. 5, the arrangement being such that as the piston rod is moved leftwards in FIG. 5 by the compressed air from the valve 28, which preferably has its non-return valve connected the opposite way round from the way shown in FIG. 5, the lever (not shown) of the fuel pump (not shown) is turned to position of increasingly higher rates of flow of fuel to the engine 10. The solenoid 32 of the electro-pneumatic valve must in this example be energised for speed of shaft rotation below the predetermined speed, and therefore the circuit according to FIG. 3 must be modified by having a relay RL1 which has normally open contact sets RL1-1 and RL1-2, these sets being closed whenever the relay RL1 is energised.

In a further modification, whichever form of control is provided, the apparatus of FIG. 5 is adapted, by the introduction of a shuttle valve in the connection between the control valve 28 and the actuator 34, to allow control of the actuator 34 by another supply of compressed air which may be controlled in any desired manner. The shuttle valve (not shown) has its output port connected to the actuator and its two input ports respectively connected to the valve 28 and the other supply of compressed air, so that whichever of the valve 28 and the other supply provides the higher air pressure takes control of the actuator 34.

Figure 1:
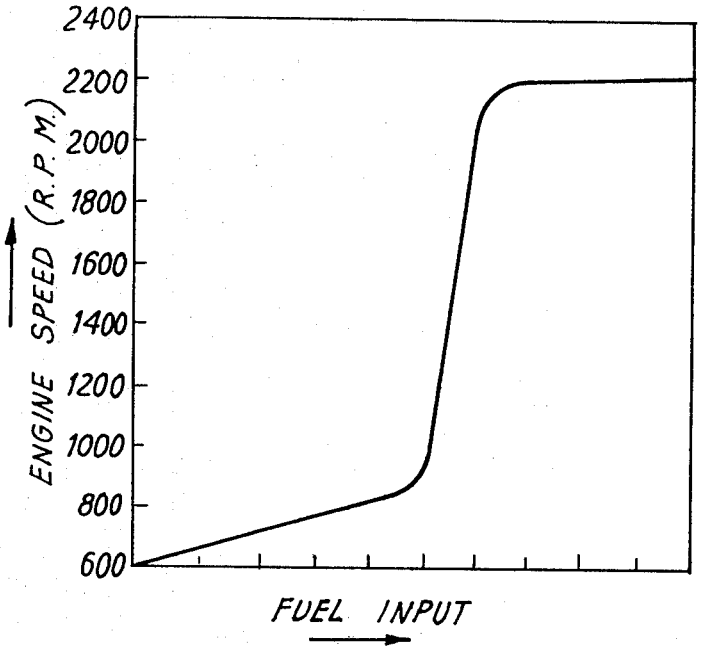
FIG. 1 is a graphical representation of engine speed against fuel input.

In embodiments of the present invention in which the engine driving the power take-off output shaft has an engine speed v. fuel input characteristic such as that of FIG. 1, the two or more reference rates for the output shaft, e.g. x r.p.m. and y r.p.m, can be chosen to provide the optimum working conditions for the power take-off apparatus with regard to the expected load on the power take-off output shaft, despite the rapid rate of change of engine speed with fuel input in the middle range of rates of rotation of the engine output shaft. For example, by suitable choice of x and y, the engine to which FIG. 1 relates can be caused to work in the range 1600 r.p.m. to 1800 r.p.m.

Although in all the examples shown in the drawings, the means for controlling the rate of flow of fuel has included a fuel pump, where the engine is not an injection engine the means for controlling the rate of flow of fuel will usually employ a carburettor instead of a fuel pump. In an embodiment of the present invention which employes a carburettor, a solenoid analogous to the solenoid 32 of FIG. 3 may have an armature adapted to act directly on an accelerator linkage of the carburettor since the power required to operate such a linkage does not warrant the use of a pneumatic actuator.

Figure 12:
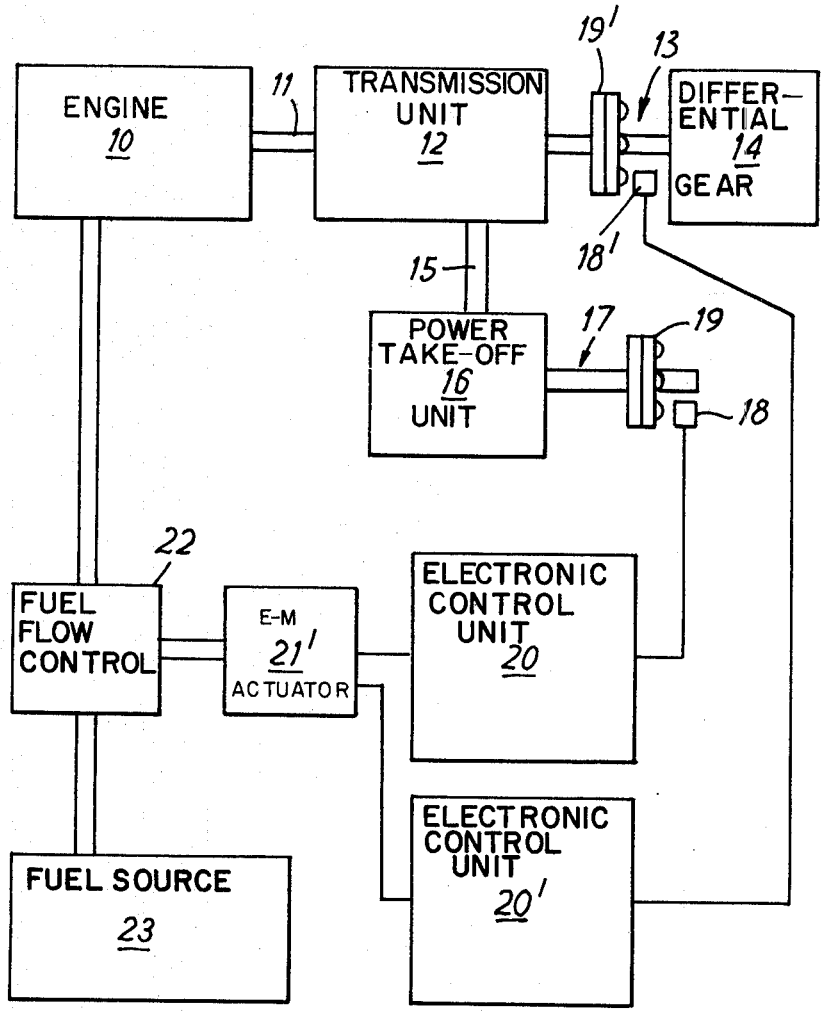
FIG. 12 is a block diagram of a drive system of a vehicle in which the propellor shaft and a power take-off output shaft are both controlled in accordance with the invention.

In FIG. 12 a vehicle drive system as in FIG. 6 is shown but in which means are included for controlling the rate of rotation of the propellor shaft 13 and hence controlling the road speed of the vehicle. Items in FIG. 12 which correspond to items in FIG. 6 are therefore given the same reference numerals as in FIG. 6. The propellor shaft 13 includes a bolted flange 19'' close to which another inductive metal-proximity sensor 18' is mounted in a position in which the sensor 18' produces a stream of electric pulses whenever the flange 19' rotates in either direction, the sensor 18' being arranged to respond to equingularly spaced bolt heads on the flange 19''. The pulses generated by the sensor 18' in response to rotation of the flange 19'' are supplied to an electronic control unit 20' which in detail is substantially the same as the unit 20. The control units 20 and 20' control respective control solenoids of an electromechanical actuator arrangement 21' which acts on the fuel flow control 22 controlling the flow of fuel to the engine 10 from the source 23.

Figure 13:
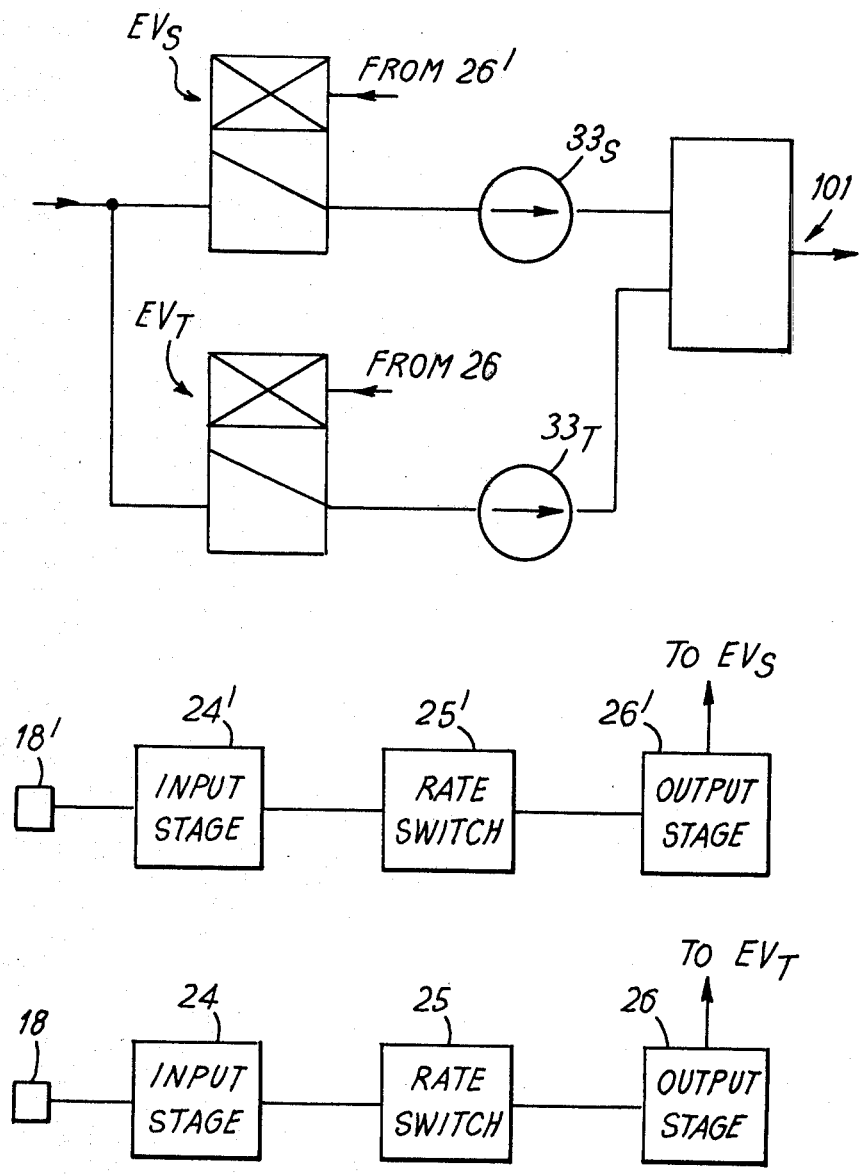
FIG. 13 is a more detailed schematic diagram of control apparatus in the vehicle drive system of FIG. 12.

The control units 20 and 20' and part of the actuator arrangement 21' are represented in FIG. 13. The control unit 20 as before consists of the input stage 24, the rate switch 25 and the output stage 26. The control unit 20' consists of corresponding input stage 24', rate switch 25' and output stage 26'. The part of the actuator arrangement 21' which is shown in FIG. 13 includes an electropneumatic valve $EV_T$ and a pressure regulator $33_T$ corresponding to the electropneumatic valve and the regulator 33 shown in FIG. 5. The valve $EV_T$ has a control solenoid connected to the output of the output stage 26. The arrangement 21' also includes an electropneumatic valve $EV_S$ and a pressure regulator $33_S$, the valve $EV_S$ being controlled by the output stage 26'. The outlet ports of the two pressure regulators $33_T$ and $33_S$ can pass air through the valve 101 to a control valve such as the valve 28 of FIG. 5. The three-way valve 101 automatically passes air from whichever one of the regulators $33_T$ and $33_S$ is receiving air from its electropneumatic valve $EV_T$ or $EV_S$ respectively. Only one of the two valves $EV_T$ and $EV_S$ is operated to pass air at any particular time since the power take-off apparatus is not in use when the vehicle is travelling, and the vehicle is stationary whenever the power take-off apparatus is in use.

The input stage 24', the rate switch 25' and the output stage 26' may be as described hereinbefore with reference to FIG. 3 and with particular component values appropriate to the speeds x r.p.m. and y r.p.m. required for control of the propeller shaft 13.

Figure 14:
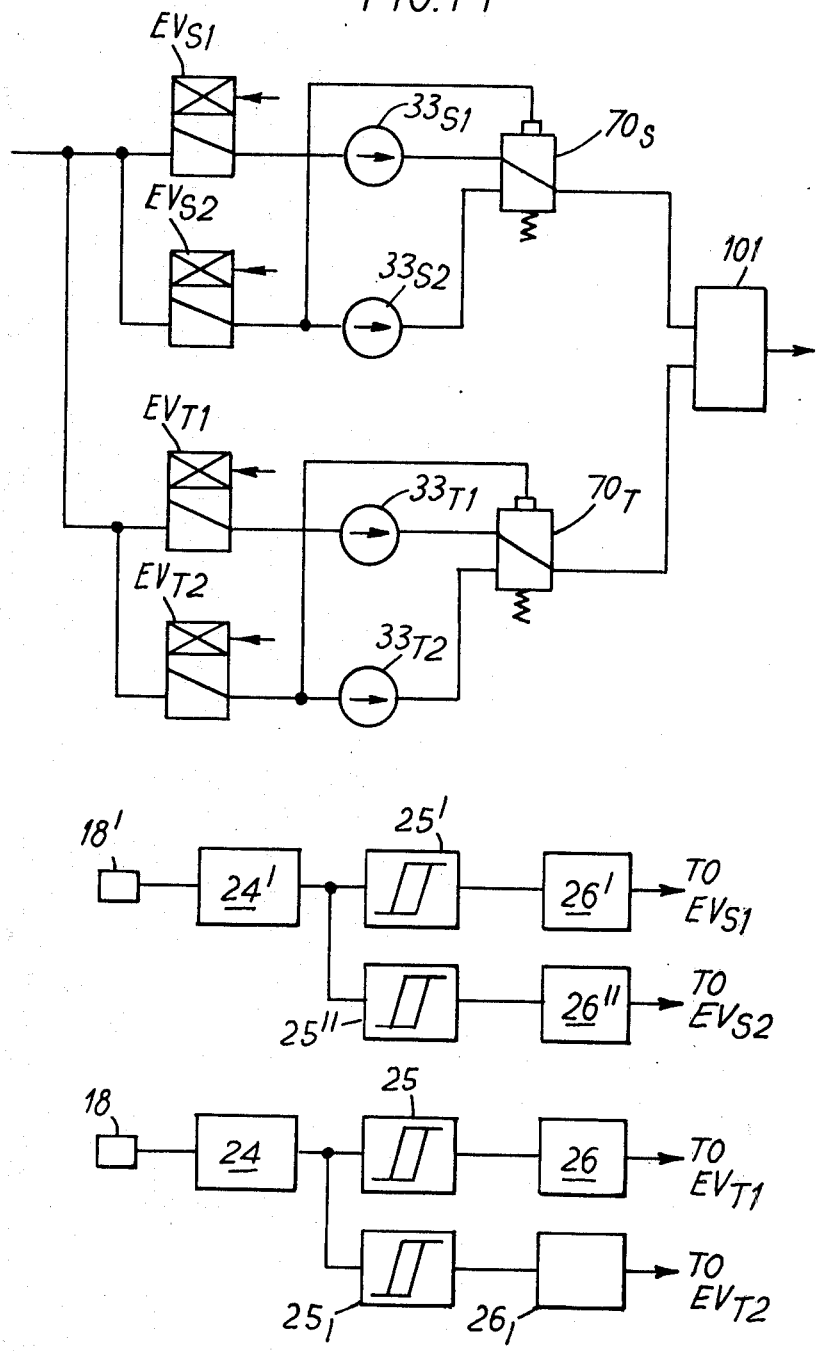
FIG. 14 is a detailed schematic diagram of control apparatus having two stage control of the propellor shaft and a power take-off output shaft in accordance with the invention.

FIG. 14 shows schematically a control apparatus which combines the features of FIGS. 13 and 7, a two stage control being provided for both the propeller shaft of the vehicle and a power take-off output shaft thereof. The control circuit for the power take-off output shaft has a single input stage 24 which supplies square pulses to two rate switches 25 and $25_1$ set for two respective speeds of rotation of the power take-off shaft. Through respective output stages 26 and $26_1$ the rate switches 25 and $25_1$ control two electropneumatic valves $EV_{T1}$ and $EV_{T2}$ respectively, which correspond to the two valves EV1 and EV2 of FIG. 7. Similarly, the control circuits for the propeller shaft has a single input stage 24' supplying square pulses to two rate switches 25' and 25'' for two respective vehicle speeds, the rate switches 25' and 25'' respectively controlling two electropneumatic valves $EV_{S1}$ and $EV_{S2}$ through respective output stages 26' and 26''.

Each of the sensors 18 and 18' may be a Bi 5-G-18-YO as manufactured by Turk GmbH of West Germany and available from Hird-Brown Limited of Bolton, Lancashire, England.

I claim:

1. In a motor vehicle equipped with power take-off apparatus driven by an internal combustion engine and including a rotary power take-off output shaft, the improvement comprising: sensor means arranged and adapted to produce pulses at a repetition rate proportional to the speed of rotation of said rotary output shaft; rate discriminating circuitry operatively coupled to said sensor means to receive said pulses and discriminate between pulse repetition rates above and below at least one predetermined rate; rate level indicating means coupled to said rate discriminating circuitry means to provide a binary output signal indicative by the prevailing level thereof of the relation of the pulse repetition rate to said at least one predetermined rate; and flow rate control means coupled to said rate level indicating means and responsive to said binary output signal to control a flow of fuel to said internal combustion engine, said flow rate control means being such as to reduce said flow of fuel in response to the level of said binary output signal indicating a pulse repetition rate exceeding at least said one predetermined rate, said rate discriminating circuitry including an astable multivibrator coupled to said sensor means so as to be inhibited by pulse repetition rates exceeding said one predetermined rate, and said rate level indicating means including a monostable circuit connected to said astable multivibrator so as to reset only in response to said astable multivibrator being inhibited for a predetermined length of time.

2. A motor vehicle as claimed in claim 1, wherein said sensor means includes an inductive sensor mounted adjacent a plurality of metal projections equiangularly disposed about and fixed to rotate with said rotary output shaft so as to produce on rotation of said rotary output shaft one pulse in response to each pass of each of said projections through the region of sensing associated with said sensor.

3. A vehicle comprising an internal combustion engine, vehicular means suporting said internal combustion engine, a fuel supply for said engine, flow rate controlling means for controlling the flow rate of fuel to said engine, output shaft means coupled to said engine to be driven thereby, means for sensing rotation of said output shaft and producing in response thereto a repetitive signal in which the duration of a repeated element is inversely related to the speed of rotation of said output shaft, an astable multivibrator coupled to said means for sensing rotation so as to be inhibited for a predetermined interval at each occurrence of one part of the said repeated element of the repetitive signal, a monostable circuit coupled to the astable multivibrator so as to be triggered into or maintained in the set state of the monostable circuit by each occurrence of at least part of a cycle of astable operation of the astable multivibrator, said predetermined interval being of shorter duration than the time for which the monostable circuit can remain in its set state in response to a single triggering thereof, and said monostable circuit providing a binary output signal representative of its state and coupled to said flow rate controlling means so as to cause said flow rate controlling means to reduce said flow rate when the duration of said repeated element becomes less than a predetermined duration when the speed of rotation of said output shaft is increasing from zero, and feedback means between the monostable circuit and the astable multivibrator which in response to the binary output signal of the monostable circuit determine the duration of said predetermined interval, said feedback means operating to prevent said flow rate controlling means from increasing said flow rate after said duration becomes less than said predetermined duration until said duration increases to longer than a further predetermined duration value which is longer than the first said predetermined duration.

4. A vehicle as claimed in claim 3, wherein said flow rate controlling means includes a mechanical member operable by a user to control said flow rate whenever said speed of rotation is increasing from zero and below a predetermined value.

5. A vehicle as claimed in claim 3, wherein said means for sensing rotation and producing in response thereto a repetitive signal comprises pulse generating means.

6. A vehicle as claimed in claim 3, wherein said monostable circuit is coupled to electrically energisable means so that the energisation of said electrically energisable means is dependent on the presence of one of the levels of the said binary signal, and the electrically energisable means is adapted to control said flow rate controlling means.

7. A vehicle as claimed in claim 6, wherein said electrically energisable means comprise a relay having a set of contacts which is adapted to control the supplying of electrical power to a solenoid comprising part of said flow rate controlling means.

* * * * *